United States Patent [19]

Ichikawa et al.

[11] Patent Number: 4,459,508

[45] Date of Patent: Jul. 10, 1984

[54] IMAGE TUBE HAVING A CONDUCTIVE FILM FOR PREVENTING SPURIOUS DISCHARGE FROM TAKING PLACE

[75] Inventors: Kozo Ichikawa; Tadao Shima; Tadafumi Hoshiyama, all of Tokyo, Japan

[73] Assignee: Nippon Electric Co., Ltd., Tokyo, Japan

[21] Appl. No.: 291,167

[22] Filed: Aug. 10, 1981

[30] Foreign Application Priority Data

Aug. 14, 1980 [JP] Japan ..... 55-112394

[51] Int. Cl.[3] ..... H01J 40/16; H01J 40/06

[52] U.S. Cl. ..... 313/529; 313/530; 313/541; 313/544

[58] Field of Search ..... 313/99, 101, 102, 94, 313/313, 523, 524, 529, 530, 537, 541, 544

[56] References Cited

U.S. PATENT DOCUMENTS 4,001,618 1/1977 Kaseman ..... 313/99 X

*Primary Examiner*—Palmer C. Demeo
*Assistant Examiner*—Sandra L. O'Shea
*Attorney, Agent, or Firm*—Laff, Whitesel, Conte & Saret

[57] ABSTRACT

An image tube comprises a conductive film along the inside surface of an insulating tube extending axially of the image tube between a photoelectric cathode and a fluorescent anode. The conductive film should be electrically connected to the photoelectric cathode and have an axial length between ½ and ¾ of that of the insulating tube. The conductive film may be formed along the outside surface of the insulating tube and either together with or without a conventional semi-insulating layer formed along the inside surface of the insulating tube.

3 Claims, 2 Drawing Figures

IMAGE TUBE HAVING A CONDUCTIVE FILM FOR PREVENTING SPURIOUS DISCHARGE FROM TAKING PLACE

BACKGROUND OF THE INVENTION

This invention relates to an image tube, which may be an image intensifier tube.

An image tube comprises an axially extending insulating tube or pipe having first and second open ends, a photoelectric cathode and a fluorescent anode sealed to the insulating tube to hermetically close in the first and second open ends, respectively, and an intermediate electrode in a hollow space enclosed with the insulating tube, the photoelectric cathode, and the fluorescent anode. The photoelectric cathode is for converting an input optical image projected thereon to a first electron image. In cooperation with the photoelectric cathode and the fluorescent anode, the intermediate electrode forms an electron lens in the hollow space for forming a second electron image on the fluorescent anode, which converts the second electron image to an output optical image. With a conventional image tube, background noise is unavoidably superposed on the output optical image. The background noise deteriorates the output optical image.

SUMMARY OF THE INVENTION

It is therefore an object of the present invention to provide an image tube, with which it is possible to suppress background noise that has inevitably been superposed on an output optical image.

It is a subordinate object of this invention to provide an image tube of the type described, which is capable of providing an excellent output optical image.

According to this invention, there is provided an image tube comprising an axially extending insulating tube having first and second open ends, a photoelectric cathode and a fluorescent anode sealed to the insulating tube to hermetically close the first and the second open ends, respectively, an intermediate electrode in a hollow space enclosed with the insulating tube, the photoelectric cathode, and the fluorescent anode, and a conductive film formed along the insulating tube in electrical contact with the photoelectric cathode and having an axial length between about $\frac{1}{2}$ and $\frac{3}{4}$ of the distance between the first and the second open ends. The conductive film may be formed on the inner or outer surface of the insulating tube and may be deposited thereon by sputtering, evaporation, application or the like method.

DESCRIPTION OF THE PREFERRED EMBODIMENTS

Figure 1:
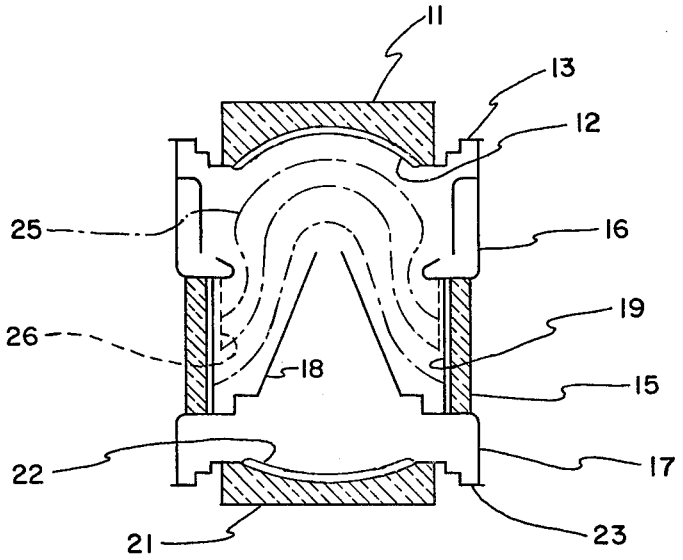
PRIOR ART FIG. 1
FIG. 1 is a diagrammatical axial sectional view of a conventional image tube.

Referring to FIG. 1, a conventional image tube will be described at first in order to facilitate an understanding of the present invention. The image tube comprises a first face plate 11, which may either be a glass fiber plate or a transparent glass plate and has a photoelectric layer 12 on one side. The photoelectric layer 12 is for convering an input optical image projected thereon to a first electron image. A first flange 13 is attached to the face plate 11 and electrically connected to the photoelectric layer 12.

An insulating tube or pipe 15 is made of an insulating material, such as glass or a ceramic material, and has first and second open ends. The insulating tube 15 is typically hollow cylindrical in shape. A cathode electrode 16 is sealed to the insulating tube 15 so as to axially extend away from the first open end. An anode electrode 17 forms another axial extension of the insulating tube 15 from the second open end. The cathode and the anode electrodes 16 and 17 are hermetically sealed to the insulating tube 15. Inside the insulating tube 15, a hollow frustoconical electrode 18 is extended coaxially of the insulating tube 15 with the frustoconical end placed adjacent to the cathode electrode 16. The electrode 18 is herein called an intermediate electrode. In the illustrated example, the intermediate electrode 18 is attached to the anode electrode 17. The inside surface of the insulating tube 15 is coated with a layer of chromium (III) oxide 19.

A second face plate 21 may be a glass fiber plate or a transparent glass plate and has a fluorescent layer 22 on one side. A second flange 23 is attached to the second face plate 21 in electrical contact with the fluorescent layer 22.

The first and the second flanges 13 and 23 are attached to the cathode and the anode electrodes 16 and 17, respectively, with the photoelectric and the fluorescent layers 12 and 22 inwardly directed. A photoelectric cathode is formed by, among others, the photoelectric layer 12 and the cathode electrode 16. A fluorescent anode is likewise formed by the anode electrode 17 and the fluorescent layer 22. The photoelectric cathode and the fluorescent anode are thus sealed to the insulating tube 15 to hermetically close the first and the second open ends, respectively. In practice, the photoelectric layer 12 is formed after an assembly of the first face plate 11 and the first flange 13 is sealed to the cathode electrode 16 to provide a half-closed tube. In any event, a hollow space is enclosed with the photoelectric cathode, the insulating tube 15, and the fluorescent anode after completion of the image tube. The intermediate electrode 18 is disposed in the hollow space.

In operation, a d.c. voltage is supplied between the cathode and the anode electrodes 16 and 17. The d.c. voltage is selected typically between 10 and 20 kV. An electron lens 25 exemplified by dash-dot lines is formed by cooperation of the photoelectric cathode, the intermediate electrode 18, and the fluorescent anode. Inasmuch as the intermediate electrode 18 is electrically connected to the anode electrode 17 in the example being illustrated, the electron lens 25 is formed between the photoelectric cathode and the intermediate electrode 18.

Electrons forming the first electron image on the photoelectric layer 12 are accelerated by the d.c. voltage and focussed by the electron lens 25 on the fluorescent layer 22 as a second electron image. The electrons impinging on the fluorescent layer 22 as the second electron image produce an output optical image complying with the second electron image. The chromium (III) oxide layer 19 is a semi-insulating layer and suppresses the surface creapage or creeping discharge, which would otherwise occur along the inside surface of the insulating tube 15.

It is already known that spurious discharge takes place somewhere in the image tube to superpose background noise on the output optical image. The backgound noise intolerably deteriorates the quality or contrast of the output optical image particularly in an image intensifier, which has a large image intensifying factor and is operable with an input optical image of an appreciably low brightness.

It has now been confirmed by applicants that the spurious discharge takes place at an inside surface portion 26 of the insulating tube 15. In this connection, it may be mentioned here that the photoelectric layer 12 is formed by first depositing a base film of a metal, such as silver or antimony, and then a photoelectrically active film of an alkali metal, such as cesium, potassium, or sodium. The metals of the base and the active films inevitably remain in the hollow space after completion of the image tube. In particular, the base and the active films are formed by evaporating the metals with the first face plate 11 and its adjacency kept at a lower temperature as compared with other parts of the half-closed tube. Consequently, a considerable amount of the evaporated metals, including silver or antimony, adheres as small particles onto the inside surface portion 26 of the insulating tube 15.

The fact was further confirmed by an experimental image tube comprising a transparent glass tube as the insulating tube 15 and put into operation at a d.c. voltage higher than usual operating voltage. Light resulting from the spurious discharge was observed at the inside surface portion 26. It was furthermore confirmed that the inside surface portion 26 did extend about a half of the axial length of the insulating tube 15 from the cathode electrode 16.

It has thus been confirmed that the background noise does not result from the surface creapage but from the fact that the light resulting from the spurious discharge irregularly illuminates the photoelectric layer 12. Electrons thereby produced are accelerated by the d.c. voltage to unavoidably bombard the fluorescent layer 22 and to superpose the background noise on the output optical image.

The backgound noise would therefore be avoided if it were possible to prevent the metal particles from depositing on the inside surface portion 26. This is, however, very difficult and next to impossible because the metals have to be evaporated into the half-closed tube.

Figure 2:
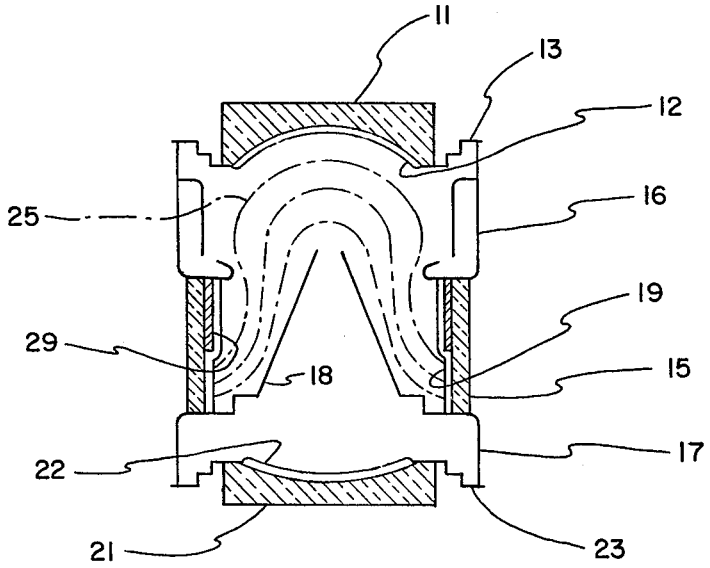
FIG. 2 is a schematic axial sectional view of an image tube according to an embodiment of the instant invention.
Figure 3:
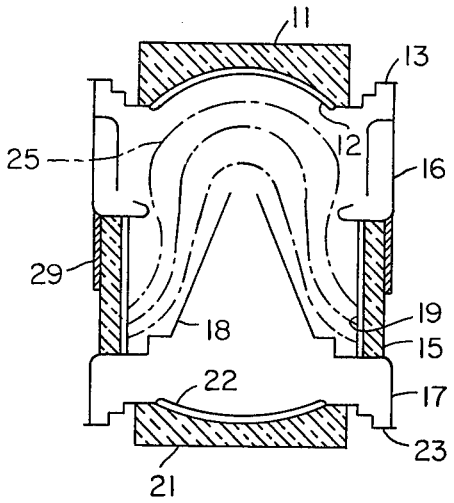

Referring now to FIG. 2, an image tube according to an embodiment of this invention comprises similar parts designated by like reference numerals. An aluminium film 29 is evaporated onto the inside surface of the insulating tube 15 in electrical contact with the cathode electrode 16 so that the aluminium film 29 may be kept at the electric potential of the photoelectric cathode. The aluminium film 29 should have an area equal to that of the inside surface portion 26. The electron lens 25 formed by application of the d.c. voltage is somewhat different in shape from that depicted in FIG. 1. More specifically, the electric field along the insulating tube 15 is concentrated at a remaining inside surface portion where the small particles of the evaporated metals do not adhere. On the contrary, no electric field is produced along the inside surface portion 26. The aluminium film 29 thus prevents the spurious discharge from taking place. The background noise is suppressed to provide an excellent output optical image.

The fact was confirmed by another test image tube similar to that described hereinabove but comprising an aluminium film of the type described. No spurious discharge was observed. A like test image tube was manufactured with an aluminium film spaced apart from the cathode electrode 16 and electrically connected to the anode electrode 17. It was impossible to prevent the spurious discharge from taking place. The fact has become very clear that the spurious discharge occurs between the cathode electrode 16 and the metal particles deposited on the inside surface portion 26 and given electric potentials different from the cathode electrode 16. In addition, the aluminium film 29 was effective when the axial length was from about $\frac{1}{2}$ to about $\frac{3}{4}$ of the insulating tube 15. The spurious discharge was effectively suppressed by any conductive film other than aluminium film. The conductive film was equally effective even when formed on the outside surface of the insulating tube 15 and either together with or without the semi-insulating layer 19. The image tube may comprise two or more intermediate electrodes.

What is claimed is:

1. An image tube comprising an axially extending insulating tube having first and second open ends; a photoelectric cathode and a fluorescent anode sealed to said insulating tube to hermetically close said first and said second open ends, respectively; an intermediate electrode in a hollow space enclosed with said insulating tube, said photoelectric cathode, and said fluorescent anode; a conductive film formed along said insulating tube in electrical contact with said photoelectric cathode and having an axial length which is between about $\frac{1}{2}$ and $\frac{3}{4}$ of the distance between said first and said second open ends; said insulating tube having an inside surface, wherein said conductive film is formed along said inside surface; and a semi-insulating layer formed on said conductive film and along a remaining inside surface portion of said insulating tube.

2. An image tube comprising an axially extending insulating tube having first and second open ends; photoelectric cathode and a fluorescent anode sealed to said insulating tube to hermetically close said first and said second open ends, respectively; an intermediate electrode in a hollow space enclosed with said insulating tube, said photoelectric cathode, and said fluorescent anode; and a conductive film formed along said insulating tube in electrical contact with said photoelectric cathode and having an axial length which is between about $\frac{1}{2}$ and $\frac{3}{4}$ of the distance between said first and said second open ends; said insulating tube having an outside surface, wherein said conductive film is formed along said outside surface.

3. An image tube as claimed in claim 2, said insulating tube further having an inside surface, wherein a semi-insulating layer is formed along said inside surface.

* * * * *